US006764149B2

(12) United States Patent
Jurja

(10) Patent No.: US 6,764,149 B2
(45) Date of Patent: Jul. 20, 2004

(54) DRAWER SLIDE ASSEMBLY LOCKING AND RELEASE MECHANISM

(75) Inventor: Samuel Jurja, Kitchener (CA)

(73) Assignee: Compx International Inc., Mauldin, SC (US)

( * ) Notice: Subject to any disclaimer, the term of this patent is extended or adjusted under 35 U.S.C. 154(b) by 52 days.

(21) Appl. No.: 10/127,978

(22) Filed: Apr. 23, 2002

(65) Prior Publication Data

US 2003/0197453 A1 Oct. 23, 2003

(51) Int. Cl.[7] ..... A47B 88/16
(52) U.S. Cl. ..... 312/333; 312/334.46
(58) Field of Search ..... 312/333, 334.44, 312/334.46, 330.1, 334.42, 334.45; 384/18, 21

(56) References Cited

U.S. PATENT DOCUMENTS

| | | | | |
|---|---|---|---|---|
| 2,277,703 A | | 3/1942 | Kennedy et al. | |
| 3,650,578 A | * | 3/1972 | Del Vecchio et al. | 312/334.46 |
| 4,993,847 A | | 2/1991 | Hobbs | |
| 4,998,828 A | * | 3/1991 | Hobbs | 312/334.46 |
| 5,033,805 A | * | 7/1991 | Hobbs | 312/333 |
| 5,085,523 A | * | 2/1992 | Hobbs | 384/21 |
| 5,169,238 A | | 12/1992 | Schenk | |
| 5,248,195 A | * | 9/1993 | Shin | 312/334.33 |
| 5,281,021 A | * | 1/1994 | Rock et al. | 312/334.46 |
| 5,466,060 A | | 11/1995 | Hoffman | |
| 5,671,988 A | | 9/1997 | O'Neill | |
| 5,695,265 A | | 12/1997 | Hoffman | |
| 5,757,109 A | | 5/1998 | Parvin | |
| 5,851,059 A | | 12/1998 | Cirocco | |
| 5,868,479 A | | 2/1999 | Hoffman | |
| 6,033,047 A | | 3/2000 | Hoffman | |
| 6,155,661 A | | 12/2000 | O'Neil et al. | |
| 6,296,338 B1 | * | 10/2001 | Stijns | 312/333 |
| 6,367,899 B1 | | 4/2002 | Hwang et al. | |
| 6,375,290 B1 | | 4/2002 | Lin et al. | |
| 6,390,575 B1 | * | 5/2002 | Chen et al. | 312/334.46 |
| 6,412,891 B1 | | 7/2002 | Liang et al. | |
| 6,450,600 B1 | * | 9/2002 | Chen et al. | 312/334.46 |
| 2002/0021061 A1 | | 2/2002 | Lammens | |

FOREIGN PATENT DOCUMENTS

| | | | | |
|---|---|---|---|---|
| CA | 2044203 | | 3/1997 | |
| DE | 202 02 750 U | | 6/2002 | |
| EP | 0439774 | * | 8/1991 | |
| JP | 03165712 | * | 7/1991 | 312/334.46 |
| JP | 06245831 | * | 9/1994 | 312/334.44 |

* cited by examiner

*Primary Examiner*—Lanna Mai
*Assistant Examiner*—Hanh V. Tran
(74) *Attorney, Agent, or Firm*—Banner & Witcoff, Ltd.

(57) ABSTRACT

A locking and release mechanism for a slide assembly comprised of multiple telescoping channel members interacting, opposing cantilever springs mounted on the telescoping slides or channel. The mechanism can be made of plastic, spring steel or other alternative materials. The mechanism can be used on ball bearing or friction telescoping drawer slide assemblies.

6 Claims, 3 Drawing Sheets

FIG.4
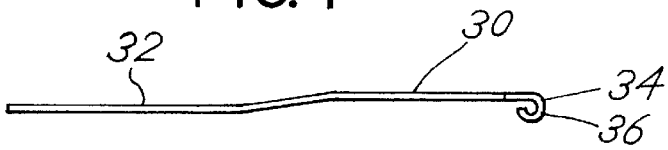
FIG.5
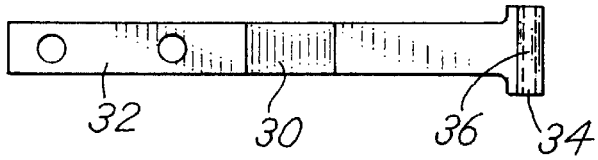
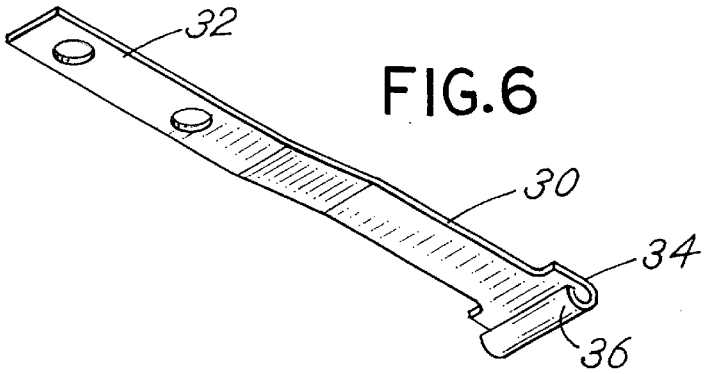
FIG.6
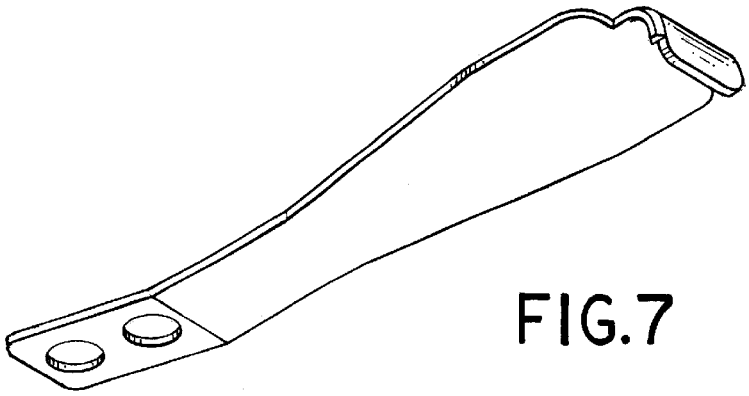
FIG.7

DRAWER SLIDE ASSEMBLY LOCKING AND RELEASE MECHANISM

BACKGROUND OF THE INVENTION

In a principal aspect the present invention relates to a mechanism, incorporated in a drawer slide assembly having multiple telescoping slide channels for locking one telescopic, slide channel or member in an extended position in a second slide channel and subsequently manually release the telescoped slide channel from its locked and extended position by means of a manual release construction which avoids exposure to a pinch point.

Multiple drawer cabinets for office storage and the like include drawers that are typically mounted on slide assemblies comprised of two or more nesting, telescopically movable slide channels or members which are attached respectively to the inside of a cabinet housing and the outside of the drawer. Various types of such slide assembly mechanisms have been developed to facilitate the safe and efficient movement of drawers between a drawer closed position and a drawer open position.

Often it is desirable to open a drawer and maintain the drawer in the open position as the contents of the drawer are reviewed or accessed. Various mechanisms incorporated in the slide assembly have been proposed for maintaining drawers in an open, locked position. Typically such mechanisms require manual release and thus exposure of the individual using the drawer to pinch points associated with the locking mechanism for the slide assembly. Development of a locking and release mechanism for a slide assembly which minimizes or avoids exposure of individuals to pinch points is thus a desirable objective and one motivation for development of the present invention.

SUMMARY OF THE INVENTION

Briefly, the present invention comprises a locking and release mechanism for a drawer slide which provides for automatic locking of a multiple channel slide assembly in an extended position and manual release when in the extended position.

Thus the slide assembly will include at least a first or outer slide channel and a second or inner slide channel which telescopically slides in the outer slide channel in a longitudinal axial direction. Each of the slide channels includes a center span or web. The center webs are in opposed, generally parallel relation to one another and slide longitudinally with respect to each other as the channels slide. The inner slide channel includes a first cantilever spring mounted on the central web with an active biased end that extends into the pathway of the center web of the outer slide channel when the inner slide channel is moved to the extended position to block or preclude movement of the inner channel slide to the retracted position once the inner slide channel has been extended. In order to release the first cantilever spring associated with the inner slide channel, a second cantilever spring is mounted on the center web of the outer slide channel. The second cantilever spring includes a prong which extends over the end of the outer slide channel in alignment with the longitudinal axis and opposed to the first cantilever spring mounted on the inner slide channel. The prong may be manually actuated to move toward and engage the first cantilever spring on the inner slide channel and thereby release it from blocking movement of the inner slide channel telescoping into the outer slide channel. Because the prong overlies the end of the outer slide channel, the described arrangement precludes exposure to a pinch point associated with the outer slide channel and, in particular, with the region of engagement of the outer slide channel with the first cantilever spring mounted on the inner slide channel.

Thus it is an object of the invention to provide an improved slide assembly having a feature which locks the slide assembly in an extended position while providing a safe and efficient release mechanism to enable release of the slide assembly from the extended position.

Another object of the invention is to provide a simple, effective, unobtrusive, and accessible mechanism for slide assemblies which will lock the assembly in an extended position and yet provide for easy release from the locked position.

Another object of the invention is to provide a locking and release mechanism for slide assemblies which may be easily incorporated in slide assemblies of the type hereto manufactured without significant modification.

These and other objects, advantages and features of the invention will be set forth in the detailed description that follows.

BRIEF DESCRIPTION OF THE DRAWING

In the detailed description which follows, reference will be made to the drawing comprised of the following figures:

FIG. 4 is a side elevation of the release cantilever spring;

FIG. 5 is a top elevation of the spring of FIG. 4;

FIG. 6 is an isometric view of the spring of FIG. 4;

FIG. 7 is an isometric view of the locking spring; and

DESCRIPTION OF THE PREFERRED EMBODIMENT

Figure 1:
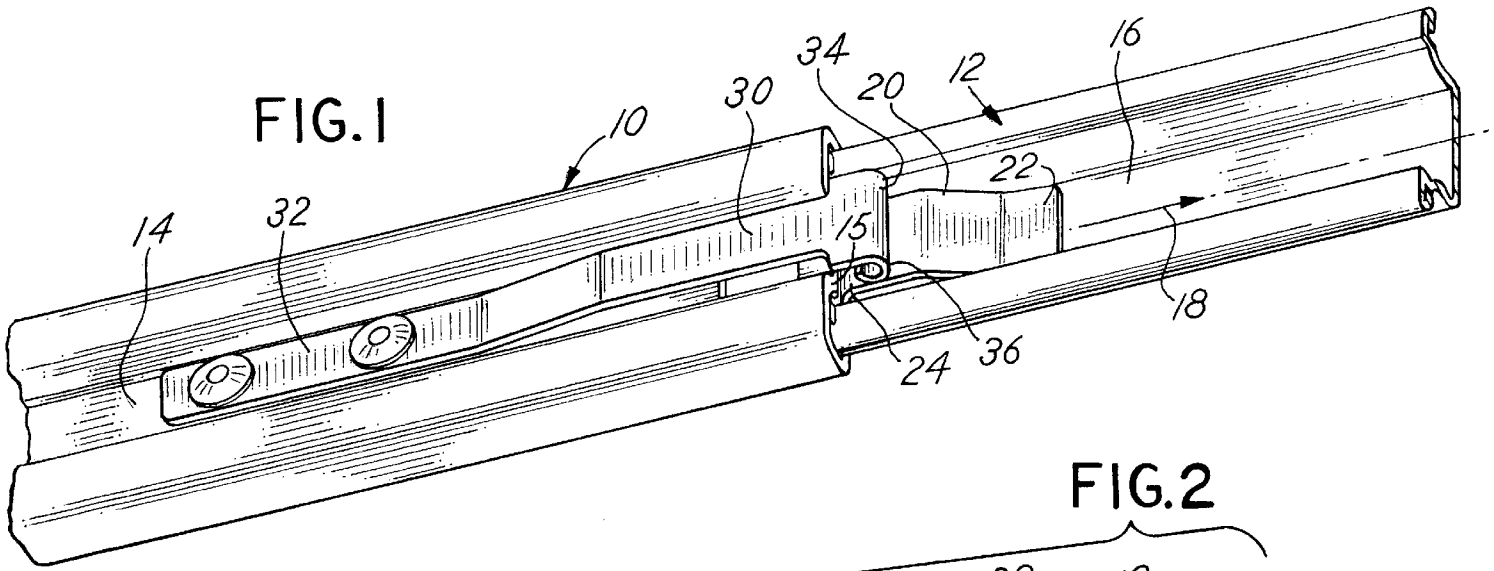
FIG. 1 is an isometric view of the locking and release mechanism for a drawer slide assembly.
Figure 2:
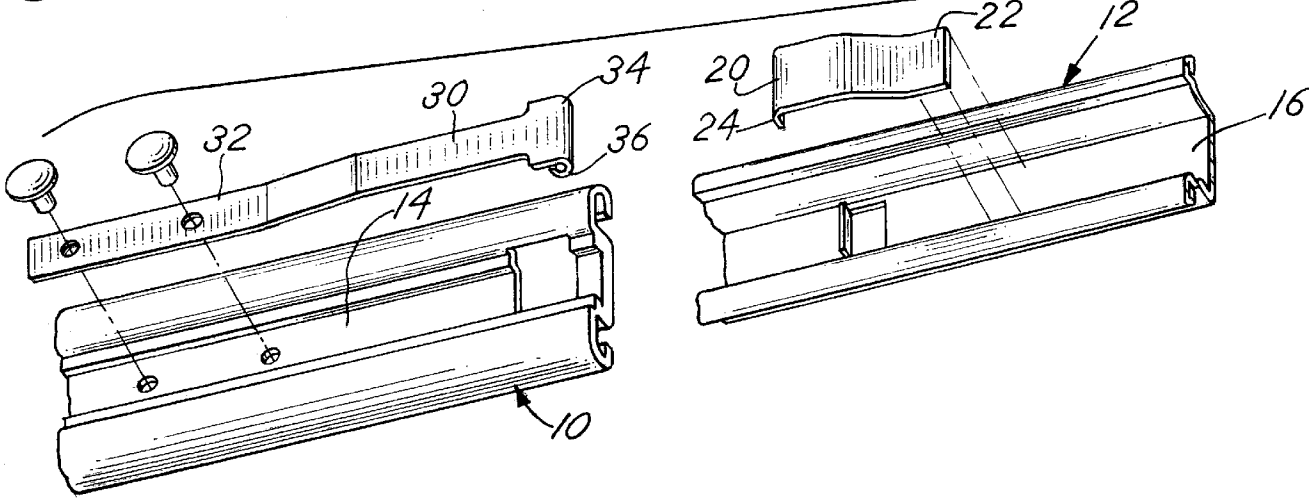
FIG. 2 is an exploded isometric view of the assembly of FIG. 1.
Figure 8:
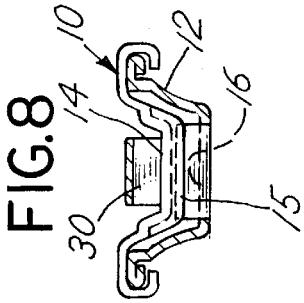
FIG. 8 is a cross sectional view of the assembly taken along the line 8—8 in FIG. 3*a*.
Figure 3A:
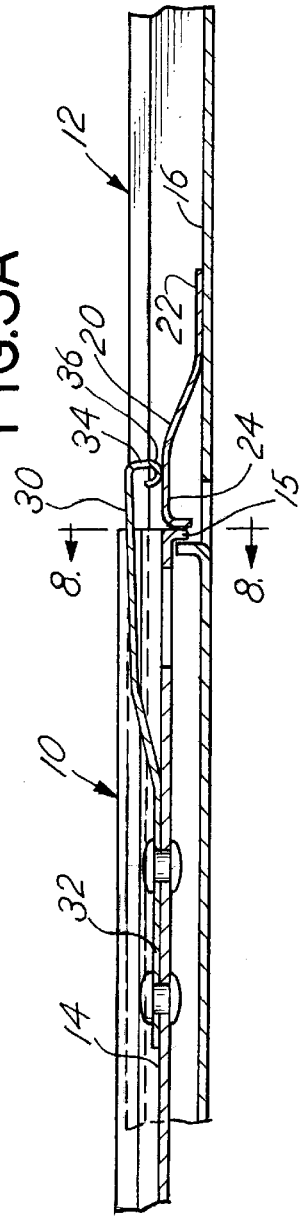
FIG. 3*a* is a cross sectional view of the locking and release mechanism as incorporated in a drawer slide with slide channels in the locked position.
Figure 3B:
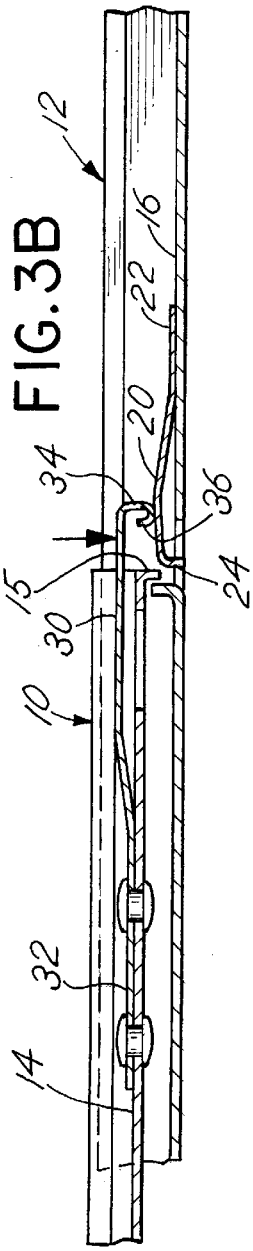
FIG. 3*b* is a cross sectional view similar to FIG. 3*a* wherein the release mechanism has been actuated to effect release of the slide channels with respect to one another.
Figure 3C:
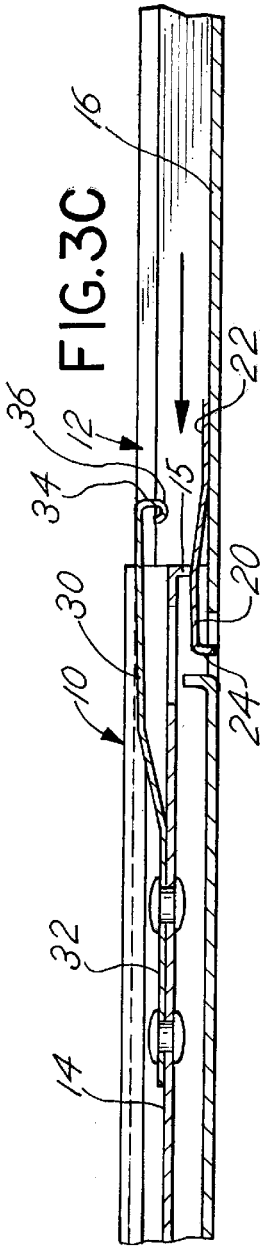
FIG. 3*c* is a cross sectional view illustrating a further sequence in the operation of the release mechanism and wherein the slide channels have been moved longitudinally one with respect to the other.

The figures illustrate a typical telescopic slide assembly which includes a first or outer slide channel or member and second or inner slide channel or member 12. The inner slide channel 12 telescopically slides within the outer slide channel 10. The outer slide channel 10 includes a central web or plate 14. Similarly, the inner or second slide channel 12 includes a central web or plate 16. The inner slide channel or slide 12 slides longitudinally in a direction along an axis 18 within the first or outer slide or slide channel 10. The outer slide 10 is typically connected to an inner drawer cabinet wall, for example, or alternatively is incorporated in a further slide channel that is attached to an inner cabinet wall. The inner slide or second slide 12 is attached to the outside of a drawer. Thus as the drawer is opened, the inner slide or second slide 12 will move in the direction indicated by the arrow in FIG. 1 along axis 18 and telescopically extends from the first or outer slide 10.

The embodiment of the invention includes a mechanism which will maintain the inner or second slide 12 in an extended position. This mechanism comprises a cantilever spring 20. The cantilever spring 20 includes a first end 22 which is fastened to the web 16 of the second or inner slide 12. The cantilever spring 20 includes a second active or free end 24 which is biased away from the web 16 by virtue of the spring effect of the cantilever spring 20. The active or free end 24 of the spring 20 projects into the pathway against an end stop 15 of the first or outer channel 10 when the inner channel 12 is moved to a desired, extended position. Thus by positioning the cantilever spring 20 appropriately on the web or plate 16 a designer may provide that when slide 12 is moved to an extended position, it cannot be retracted into the outer channel or outer slide 10.

In order to release the engagement of the active end 24 of the cantilever spring 20 it is necessary to bias or move the spring 20 so as to disengage the active end 24 from the end stop 15 of web 14 of channel 10 and, more particularly, from the end of the web 14 of the first channel or slide member 10. This disengagement is accomplished by means of a release lever or second cantilever spring 30.

The second cantilever spring 30 includes the first end 32 which is fastened to the central web 14 of the outer slide 10 and a second movable, active end 34 having a prong or arcuate section 36 at its active end 34. The cantilever release spring 30 will typically be biased out of engagement with any of the slide members 12 or 14. However, in order to release the spring 20, prong 36 may be manually engaged and depressed against the spring force of the cantilever spring 30 thereby engaging the first or locking spring 20 to release the end of spring 20 from engagement from the end of the web 14 of the inner slide 10. The inner slide 12 or second slide 12 may then be longitudinally telescoped into the outer slide 10.

It should be noted that the release lever or release spring 30 is a cantilever spring and that the prong 36 is shaped in a manner to avoid exposing operator of the spring to the pinch point which is defined as the intersection between the end of the web 14 and the active end 24 of the spring 20. Thus, utilization of the release spring 30 as designed avoids exposure of an individual to a potential hazardous situation to effect release of the locking mechanism.

In the embodiment it is preferred that the cantilever springs 20, 30 be aligned longitudinally along the longitudinal axis 18 on the respective webs 14 and 16 and that the active ends of each of the cantilever springs 20, 30 are in opposed relationship. However, it is possible to reverse the construction of the locking spring 20 by providing a tab (not shown) which would project upwardly and into the pathway of the end or web 14 of the outer channel 10. The release mechanism to for such a configuration would be substantially the same as depicted for the construction of the locking spring 20.

The materials which are utilized to provide the spring mechanism may be spring steel, plastic, or other alternatives. Further, the mechanism is useful for various types of drawer slides having two or more nesting slides. Thus the mechanism may be used on ball bearing or friction telescoping drawer slides. Various other alterations and changes to the design and construction of the invention are possible. Thus the invention is to be limited only by the following claims and equivalents thereof.

What is claimed is:

1. A drawer slide assembly comprising, in combination:

a first slide, said first slide including a generally planar center web with an outside surface and an inside surface, said center web having an end comprising a stop;

a second slide telescopically mounted in the first slide opposed to the inside surface, said second slide slidable between a retracted position and an extended position, said second slide including a biased stop member mounted on the second slide and positioned between the slides when said second slide is in the retracted position to engage the first slide end when the second slide is in an extended position by telescopic movement and thereby resist return movement of the second slide toward the retracted position;

a stop member release mechanism mounted on the outside surface of the planar center web of the first slide member, said release mechanism including a stop member engagement and release prong which extends over and beyond the first slide end and a prong biasing mechanism for biasing the prong away from engagement with the stop member, said prong further including a manual actuation surface for receipt of manual pressure counter to the force of the biasing mechanism to thereby engage the prong with the stop member and effect disengagement from first slide by displacement from the pathway of the first slide end when moving from the extended to the retracted position.

2. The drawer slide assembly of claim 1 wherein the release mechanism comprises a cantilever spring member mounted on the outside surface of the first slide, said spring member having a first end attached to the first slide and a second end comprising the prong and manual actuation surface extending beyond the end of the first slide.

3. The drawer slide assembly of claim 2 wherein the stop member comprises a cantilever spring stop member having a first end mounted to the second slide and a first slide end engaging end with a spring mechanism biasing the first slide engaging end into the slide path of the first slide when the second slide is in the extended position.

4. The drawer slide assembly of claim 2 wherein the cantilever spring member comprises an elongate plate member with the elongate dimension aligned in the direction of second slide movement to engage the slide stop member.

5. The drawer slide assembly of claim 2 wherein the cantilever spring member comprises an elongate plate member attached to the outside surface of said first slide web at a fixed end of the plate member and having an unattached opposite end with an elongate dimension in the direction of second slide movement, and including said prong projecting toward the slide path of the second slide, and biased by said elongate plate member in the opposite direction from said prong to normally maintain the prong out of the pathway of the second slide.

6. A drawer slide assembly with a mechanism for locking and releasing a second slide in an extended telescoped position in a first slide, said assembly comprising, in combination:

a first outer slide having a longitudinal axis, a slide end and a central web with an outside surface and an inside surface;

a second inner slide, telescopically mounted in the first slide for movement in the direction of the longitudinal axis to an extended positions, said second slide including a central web opposed to the inside surface of the first slide central web;

a first cantilever spring release member attached having one end attached to outside surface of the first slide central web and an opposite end extending longitudinally and including a release prong extending beyond the first slide end;

a second cantilever spring member having one end attached to the central web of the second slide between said slides and having an opposite end spring biased into the pathway of the first slide when the second slide is in an extended position to thereby preclude longitudinal telescopically sliding movement of the second slide along a pathway into the first slide, whereby the prong of said spring release member overlies the opposite end of the second spring member when the second slide is in the extended position and may be manually manipulated to engage and drive the second spring member out of the pathway of the first slide and thereby release the second slide for telescopic movement into the first slide.

* * * * *